US009975057B2

(12) United States Patent
Howell et al.

(10) Patent No.: US 9,975,057 B2
(45) Date of Patent: May 22, 2018

(54) WATER ROCKET WATER TRANSFER STATION

(71) Applicants: William Scott Howell, Lynn Havan, FL (US); Scott Douglas Farner, Panama City, FL (US)

(72) Inventors: William Scott Howell, Lynn Havan, FL (US); Scott Douglas Farner, Panama City, FL (US)

(73) Assignee: William Scott Howell, Lynn Haven, FL (US)

( * ) Notice: Subject to any disclaimer, the term of this patent is extended or adjusted under 35 U.S.C. 154(b) by 357 days.

(21) Appl. No.: 14/941,521

(22) Filed: Nov. 13, 2015

(65) Prior Publication Data

US 2017/0136376 A1 May 18, 2017

(51) Int. Cl.

| | |
|---|---|
| ***A63H 27/00*** | (2006.01) |
| ***A63H 27/14*** | (2006.01) |
| ***B67D 7/02*** | (2010.01) |

(52) U.S. Cl.

CPC ..... *A63H 27/14* (2013.01); *A63H 27/005* (2013.01); *B67D 7/0294* (2013.01)

(58) Field of Classification Search

CPC ..... A63H 27/005; A63H 27/14; F16K 15/20; F16K 17/168; B67D 7/0294

See application file for complete search history.

(56) References Cited

U.S. PATENT DOCUMENTS

| | | | | | |
|---|---|---|---|---|---|
| 3,046,694 | A * | 7/1962 | Holderer | A63H 27/005 | 124/57 |
| 5,415,153 | A * | 5/1995 | Johnson | A63H 27/005 | 124/57 |
| 5,839,940 | A * | 11/1998 | Ensmenger | A63H 27/005 | 124/57 |
| 2004/0159740 | A1* | 8/2004 | Lund | A63H 27/005 | 244/63 |
| 2005/0191930 | A1* | 9/2005 | Foster | A63H 27/001 | 446/57 |
| 2010/0248580 | A1* | 9/2010 | Lin | A63H 27/005 | 446/56 |

* cited by examiner

*Primary Examiner* — Ryan A Reis

(57) ABSTRACT

A water-rocket water-transfer-station, referred to as the water station, is comprised of a specialized manifold combined with a plastic carbonated drink bottle, which functions as a water reservoir. The water reservoir is pressurized with air to make a water transfer station for water rockets. By using pressurized air, water can be transferred from the water station to a water rocket launch system, referred to as the launcher, and into an attached water rocket. A second unique feature of this system is the ability to return water from the water rocket back into the water station reservoir, as in the case of an over-fill, or in a launch abort. This unique water station can easily and quickly transfer water to a water rocket from a water reservoir, and in reverse from a rocket, without having to remove the rocket from the launcher. This saves time and minimizes water waste which is important when water has to be hand carried into a remote launch field.

1 Claim, 2 Drawing Sheets

WATER ROCKET WATER TRANSFER STATION

BACKGROUND OF INVENTION

In many water rocket systems the rocket has to be filled with water before placing it on the launch mechanism, or be filled by being connected to a municipal or well water system after being placed on the launch system. These techniques of filling water rockets are inefficient, time consuming, and can limit the launch area by the length of hose used to transfer water from a water system. The advantage of this water-rocket water-transfer-station is that it can be taken to remote locations where municipal or other sources of water supply are unavailable. Using an air pump connected to the launcher, and the launcher connected to the water station by a small hose, the water station is pressurized with air through the launcher. Once the water station has been pressurized with air, the pressurized air can be used to force water from the water station, back through the hose, through the launcher, and into the water rocket before final rocket pressurization and subsequent launch.

SUMMARY OF INVENTION

In one embodiment, a water station is comprised of a specialized manifold, with appropriate mating thread, and a sealing washer to provide a water-tight seal with a carbonated drink bottle. The specialized manifold has a port and an attached small hose to connect with a specialized launcher. The water station is pressurized through the small hose via an air supply connected to the specialized launcher. The specialized manifold of the water station may also be equipped with a Schrader valve for independent pressurization when disconnected from the specialized launcher. Water and pressure are retained in the disconnected water station by an automatic shutoff valve in the end of the small hose. For safety, and for manual depressurization, a pressure relief valve with a pull-ring may be provided with the specialized manifold. When combined with a plastic carbonated drink bottle, the specialized manifold is used as a water supply reservoir to fill water rockets. By connecting an air supply to the specialized launcher, and by connecting to the specialized launcher to the water station by a small air tube, air pressure can be transferred from the assembled rocket and launcher into the water station reservoir bottle. Once the desired pressure in the water station is reached, an air/water control valve is closed isolating the launcher from the water station, then air pressure is released from the rocket using a pressure relief valve with a pull-ring. The air/water control valve can now be opened and water can be metered into the rocket, forced by the air pressure in the water station. When the desired amount of water is reached in the rocket, the air/water control valve is closed and the rocket is ready to be pressurized and launched. If desired, as in the case of an overfill, water in the rocket can be transferred back to the water station reservoir bottle by pumping a higher pressure into the rocket via the air tube and opening the air/water control valve to transfer water back into the water station reservoir. Once the water has transferred back into the water station the air/water control valve is then closed. If desired, pressure in the rocket can be relieved using a separate air valve such as a pressure relief valve with a pull-ring.

BRIEF DESCRIPTION OF THE DRAWINGS

In the accompanying drawings the water station is shown as a specialized manifold and plastic carbonated drink bottle connected to a water rocket launch system via an air/water transfer hose.

DETAILED DESCRIPTION OF THE INVENTION

Figure 1:
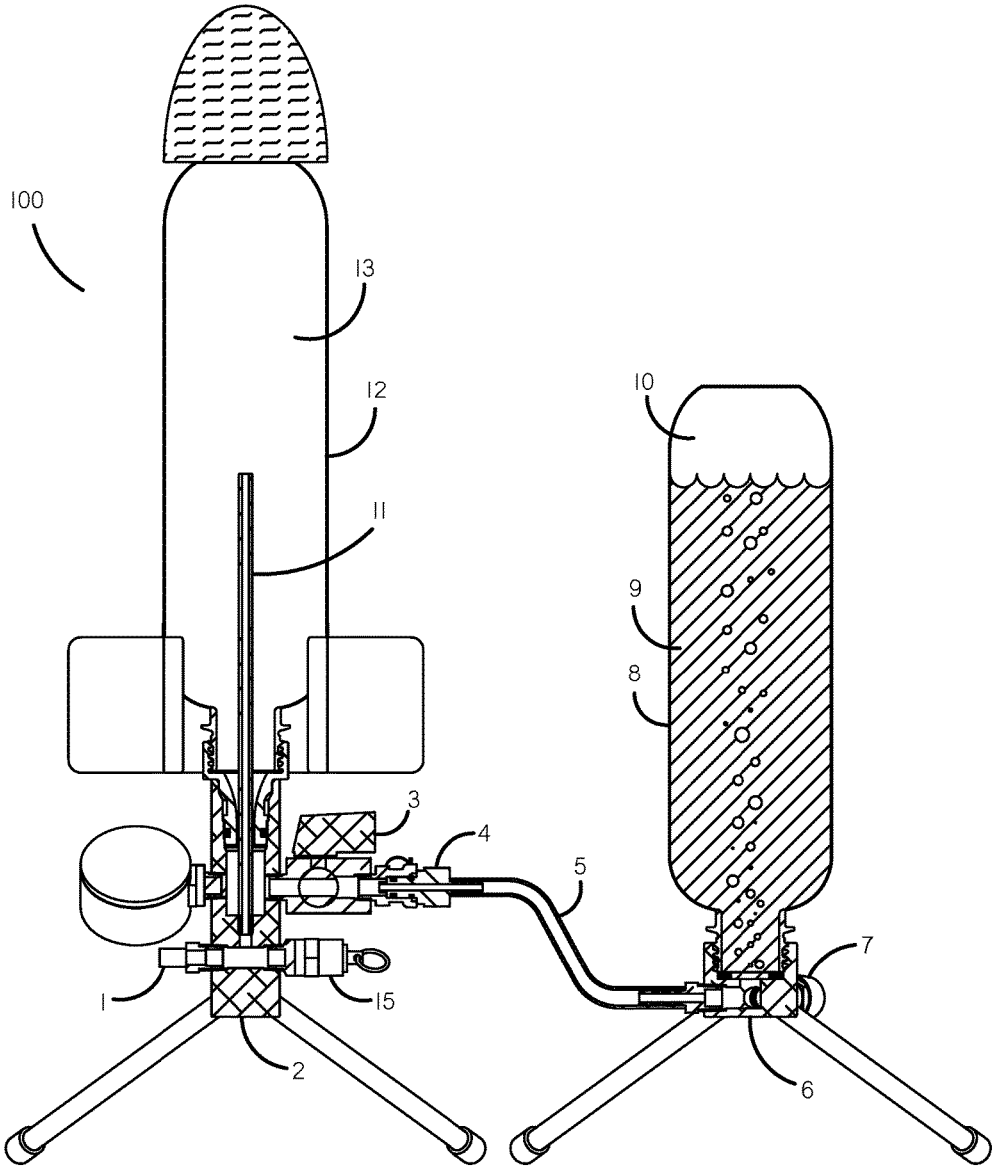
FIG. 1 is a view of one embodiment of a rocket water station with no water in the rocket.

FIG. 1 is a view of the water-rocket launch system with water station (100). The air inlet valve (1) is used to pump rocket air pressure (13) into the rocket bottle (12) via the air tube (11) of the launch system (2). By placing the air/water transfer valve (3) in the open position, air pressure (13) is transferred from rocket bottle (12) through the quick connect (4) and transfer hose (5) through water station manifold (6) into the storage bottle (8) through storage bottle water (9) into storage bottle air pressure (10). When the correct storage bottle (8) air pressure (10) is reached the air/water control valve (3) is placed in the closed position. If storage bottle air pressure (10) exceeds a preset limit, pressure relief valve (7) will release pressure. The rocket air pressure (13) is released through pressure release valve (15).

Figure 2:
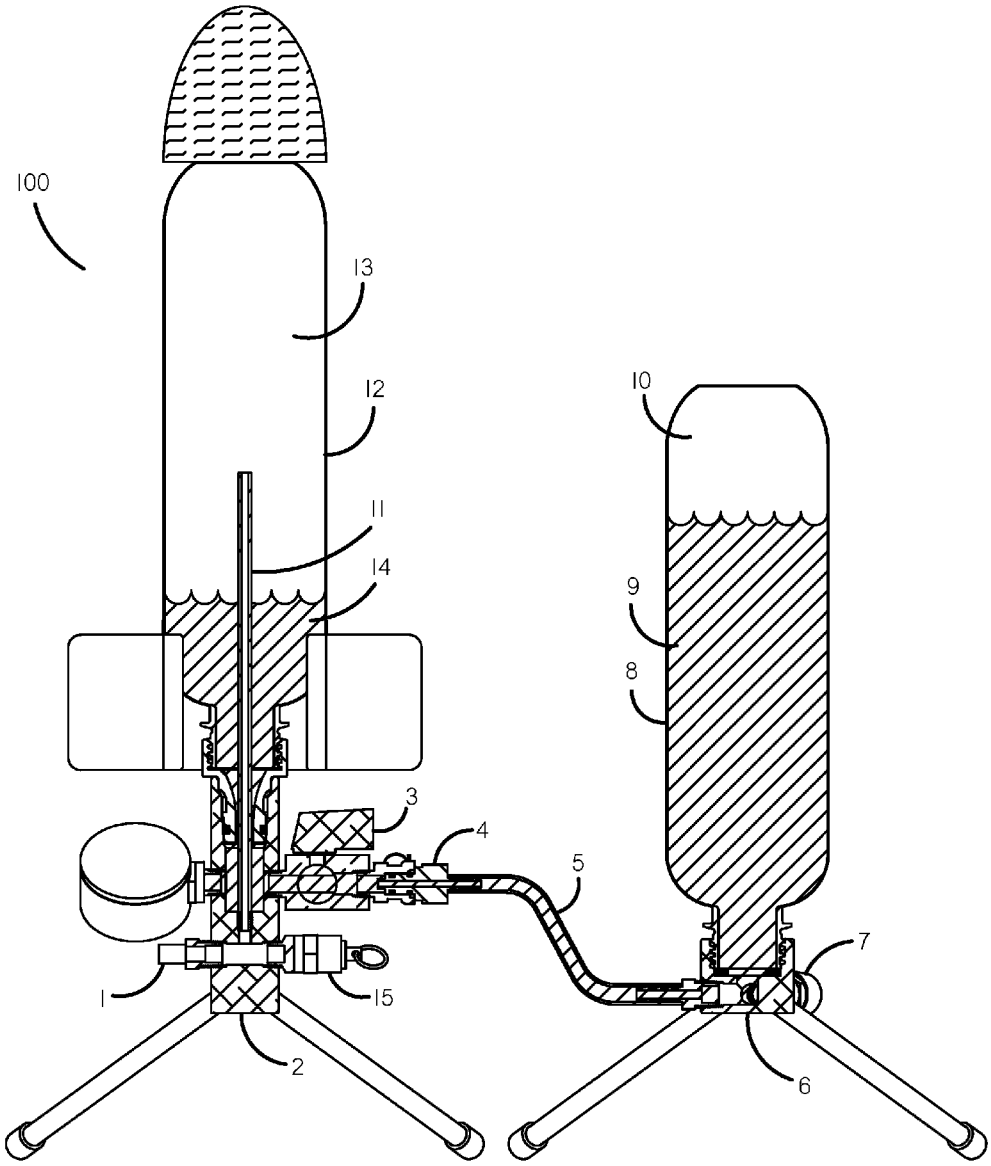
FIG. 2 is a view of one embodiment of a rocket water station with water transferred to the rocket from the water station.

FIG. 2 is a view of the water-rocket water launch system with water station (100) with rocket water (14) transferred from the fill station manifold (6) storage bottle (8) to the rocket bottle (12). By opening the air/water transfer valve (3) storage bottle (8) air pressure (10) forces storage water (9) through water station (6), transfer hose (5), quick connect (4) air/water transfer valve (3) and launch system (2) into rocket bottle (12). When the correct amount of rocket water (14) is transferred to the rocket bottle (12) the air/water control valve (3) is placed in the closed position. Air can now be pumped in through air inlet valve (1) via the air tube (11) of the launch system (2) into rocket air pressure (13) in preparation for rocket launch. Rocket water (14) can be transferred back to the storage bottle (8) by pumping a higher rocket air pressure (13) than storage bottle air pressure (10) and opening the air/water transfer valve (3) to transfer the water through launch system (2), air/water transfer valve (3), quick disconnect (4) transfer hose (5), water station (6) into storage water (9). After rocket water (14) has transferred to storage water (9) the air/water control valve (3) is placed in the closed position. The remaining rocket bottle air pressure (13) can be released from the rocket bottle (12) through pressure release valve (15). The rocket launch mechanism (2) can be disconnected from the water fill station (6) without releasing storage water (9) by depressing the release button of the quick disconnect (4) and removing the transfer hose (5) with quick disconnect (4). The quick disconnect (4) has a spring loaded valve to stop flow out of transfer hose (5) when disconnected. Storage bottle air pressure (10) can be released from storage bottle (8) by flipping over storage bottle (8) and opening pressure release valve (7) without loss of storage water (9).

The invention claimed is:

1. A water-rocket water-transfer-station comprising:

a water station manifold;

a storage bottle attached to the water station manifold;

a launch system having an air inlet valve, an air tube, and an air/water transfer valve;

a rocket bottle attached to the launch system; and a transfer hose connecting the water station manifold to the air/water transfer valve;

wherein the air/water transfer valve allows air or water to flow from the launch system to the storage bottle and allows water to flow from the storage bottle to the launch system.

* * * * *